US006753039B2

(12) United States Patent
Heimann et al.

(10) Patent No.: US 6,753,039 B2
(45) Date of Patent: Jun. 22, 2004

(54) ELECTROLYTIC AND ELECTROLESS PROCESS FOR TREATING METALLIC SURFACES AND PRODUCTS FORMED THEREBY

(75) Inventors: Robert L. Heimann, Centralia, MO (US); Branko Popov, Columbia, SC (US); Dragan Slavkov, Columbia, SC (US); Bala Haran, Columbia, SC (US)

(73) Assignee: Elisha Holding LLC, Moberly, MO (US)

( * ) Notice: Subject to any disclaimer, the term of this patent is extended or adjusted under 35 U.S.C. 154(b) by 0 days.

(21) Appl. No.: 10/211,029

(22) Filed: Aug. 2, 2002

(65) Prior Publication Data

US 2003/0034095 A1 Feb. 20, 2003

Related U.S. Application Data

(60) Provisional application No. 60/310,006, filed on Aug. 3, 2001.

(51) Int. Cl.[7] ..... B05D 3/02; B05D 3/10

(52) U.S. Cl. ..... 427/376.1; 427/301; 427/304; 148/240; 148/243

(58) Field of Search ..... 427/376.1, 301, 427/304; 106/1.05; 148/240, 243

(56) References Cited

U.S. PATENT DOCUMENTS

| | | | | |
|---|---|---|---|---|
| 3,444,007 A | * | 5/1969 | Maurer et al. | 148/273 |
| 3,677,827 A | | 7/1972 | Weaver et al. | |
| 3,899,367 A | | 8/1975 | Mitchell | |
| 3,929,514 A | * | 12/1975 | Houlihan et al. | |
| 5,057,335 A | * | 10/1991 | Hanagata et al. | 427/512 |
| 5,068,134 A | * | 11/1991 | Cole et al. | |
| 5,326,594 A | | 7/1994 | Sabata et al. | |
| 5,399,210 A | | 3/1995 | Miller | |
| 5,407,749 A | * | 4/1995 | Bishop | |
| 5,419,790 A | | 5/1995 | Miller | |
| 5,487,919 A | | 1/1996 | Tobiyama et al. | |
| 5,582,654 A | | 12/1996 | Mansfeld et al. | |
| 6,183,649 B1 | * | 2/2001 | Fontana | 210/699 |
| 6,527,825 B1 | * | 3/2003 | Gruenbauer et al. | |
| 2002/0119895 A1 | * | 8/2002 | Cook et al. | |
| 2003/0118861 A1 | * | 6/2003 | Heimann et al. | |

FOREIGN PATENT DOCUMENTS

| | | | |
|---|---|---|---|
| GB | 342256 | | 1/1931 |
| GB | 1113148 | | 5/1968 |
| JP | 53-31538 A | * | 3/1978 |
| WO | WO 00/36176 | | 6/2000 |

OTHER PUBLICATIONS

PCT Notification of Transmittal of the International Search Report or the Declaration—EL023RH–PCT—Nov. 26, 2003.

Corrosil CPS R Top Coat for Passivated Zinc & Zinc Alloys—Technical Information—ATOTECH USA Inc., Rock Hill, SC—Sheet No.:Corrosil CVS R Revision: 09/23/02T–494.

Rogard Supreme Seal 500—Technical Information—ATOTECH USA Inc., Rock Hill, SC—Sheet No.: ROGARD 500 Revision: 02/20/01T–1059.

Preparation of Silica Thin Films by Electrolyscs of Aqueous Solution—Masaya Chigane, Masami Ishikawa, and Masanobu Izuki—Department of Inorganic Chemistry, Osaka Municipal Technical Research Institute, Joto–ku, Osaka 536–8553, Japan—Manuscript submitted Mar. 12, 2001: revised manuscript received Jun. 17, 2002. Available electronically Aug. 14, 2002 (pp. D9–D12).

* cited by examiner

*Primary Examiner*—Michael Barr
(74) *Attorney, Agent, or Firm*—Michael K Boyer

(57) ABSTRACT

The disclosure relates to an electroless or electrolytic process for treating metallic surfaces. The process employs a medium comprising at least one oxygen containing water soluble compound (e.g., stannates, molybdates, vanadates and hydrated cerium compounds) having a controlled and predetermined concentration, temperature and pH wherein the metallic surface is at least partially corroded or solubilized.

20 Claims, No Drawings

ELECTROLYTIC AND ELECTROLESS PROCESS FOR TREATING METALLIC SURFACES AND PRODUCTS FORMED THEREBY

The subject matter herein claims benefit of prior filed U.S. Patent Application Serial No. 60/310,006, filed on Aug. 03, 2001 and entitled "An Electrolytic And Electroless Process For Treating Metallic Surfaces and Products Formed Thereby"; the disclosure of which is hereby incorporated by reference.

CROSS REFERENCE TO RELATED PATENTS AND PATENT APPLICATIONS

The subject matter of the instant invention is related to copending and commonly assigned WIPO Patent Application Publication No. WO 98/33960, Non-Provisional U.S. patent application Ser. No. 08/850,323 (Now U.S. Pat. No. 6,165,257); Ser. No. 08/850,586 (Now U.S. Pat. No. 6,143, 420); and Ser. No. 09/016,853 (now allowed), filed respectively on May 2, 1997 and Jan. 30, 1998; and Ser. No. 08/791,337 (now U.S. Pat. No. 5,938,976), filed on Jan. 31, 1997, in the names of Robert L. Heimann et al., as a continuation in part of Ser. No. 08/634,215 (filed on Apr. 18, 1996) in the names of Robert L. Heimann et al., and entitled "Corrosion Resistant Buffer System for Metal Products", which is a continuation in part of Non-Provisional U.S. patent application Ser. No. 08/476,271 (filed on Jun. 7, 1995) in the names of Heimann et al., and corresponding to WIPO Patent Application Publication No. WO 96/12770, which in turn is a continuation in part of Non-Provisional U.S. patent application Ser. No. 08/327,438 (filed on Oct. 21, 1994), now U.S. Pat. No. 5,714,093.

The subject matter of this invention is related to Non-Provisional patent application Ser. No. 09/016,849, filed on Jan. 30, 1998 and entitled "Corrosion Protective Coatings". The subject matter of this invention is also related to Non-Provisional patent application Ser. No. 09/016,462, filed on Jan. 30, 1998 and entitled "Aqueous Gel Compositions and Use Thereof" (now U.S. Pat. No. 6,033,495).

The subject matter of this invention is also related to Non-Provisional patent application Ser. No. 09/814,641, filed on Mar. 22, 2001, and entitled "An Energy Enhanced Process For Treating A Conductive Surface And Products Formed Thereby" (and corresponds to PCT Patent Application Serial No. PCT/US01/09293), and Non-Provisional patent application Ser. No. 10/211,094, filed on Aug. 3, 2002 and entitled "An Electroless Process For Treating Metallic Surfaces And Products Formed Thereby", and Ser. No. 10/211,051, filed on Aug. 3, 2002 and entitled "An Electroless Process For Treating Metallic Surfaces And Products Formed Thereby".

The disclosure of the previously identified patents, patent applications and publications is hereby incorporated by reference.

FIELD OF THE INVENTION

The instant invention relates to a process for forming a deposit on the surface of a metallic or conductive surface. The process employs a process to deposit, for example, a mineral containing coating or film upon a metallic, metal containing or an electrically conductive surface.

BACKGROUND OF THE INVENTION

Silicates have been used in electro cleaning operations to clean steel, tin, among other surfaces. Electro cleaning is typically employed as a cleaning step prior to an electroplating operation. Usage of silicates as cleaners is described in "Silicates As Cleaners In The Production of Tinplate" is described by L. J. Brown in February 1966 edition of Plating; European Patent No. 00536832/EP B1 (Metallgesellschaft A G); U.S. Pat. Nos. 5,902,415, 5,352, 296 and 4,492,616.

Processes for electrolytically forming a protective layer or film by using an anodic method are disclosed by U.S. Pat. No. 3,658,662 (Casson, Jr. et al.), and United Kingdom Patent No. 498,485.

U.S. Pat. No. 5,352,342 to Riffe, which issued on Oct. 4, 1994 and is entitled "Method And Apparatus For Preventing Corrosion Of Metal Structures" that describes using electromotive forces upon a zinc solvent containing paint; hereby incorporated by reference. U.S. Pat. Nos. 5,700,523, and 5,451,431; and German Patent No. 93115628 describes a processes for using alkaline metasilicates to treat metallic surfaces.

The disclosure of each of the previously identified references is hereby incorporated by reference.

SUMMARY OF THE INVENTION

The instant invention solves problems associated with conventional practices by providing an electroless or electrolytic process for treating metallic surfaces. The process employs a medium comprising at least one oxygen containing water soluble compound having a controlled and predetermined concentration, temperature and pH wherein the metallic surface is at least partially corroded or solubilized. As a result, the medium interacts with the metallic surface to form a new or modified surface having one or more improved properties.

The inventive process can form a surface comprising a mineral layer comprising an amorphous matrix surrounding or incorporating crystals upon the substrate. The characteristics of the mineral layer are described in greater detail in the copending and commonly assigned patent applications listed below.

A metallic surface that is treated (e.g., forming the mineral layer) by the inventive process can possess improved corrosion resistance, increased electrical resistance, heat resistance, flexibility, resistance to stress crack corrosion, adhesion to sealer, paints and topcoats, among other properties. The improved heat resistance broadens the range of processes that can be performed subsequent to forming the inventive layer, e.g., heat cured topcoatings, stamping/shaping, riveting, among other processes. The corrosion resistance can be improved by adding a dopant to the silicate medium, using a rinse and/or applying at least one sealer/topcoating.

The inventive process is a marked improvement over conventional methods by obviating the need for solvents or solvent containing systems to form a corrosion resistant layer, e.g., a mineral layer. In contrast, to conventional methods the inventive process can be substantially solvent free. By "substantially solvent free" it is meant that less than about 5 wt. %, and normally less than about 1 wt. % volatile organic compounds (V.O.C.s) are present in the electrolytic environment.

The inventive process is also a marked improvement over conventional methods by reducing, if not eliminating, chromate and/or phosphate containing compounds (and issues attendant with using these compounds such as waste disposal, worker exposure, among other undesirable environmental impacts). While the inventive process can be employed to enhance chromated or phosphated surfaces, the inventive process can replace these surfaces with a more environmentally desirable surface. The inventive process, therefore, can be "substantially chromate free" and "substantially phosphate free" and in turn produce articles that are also substantially chromate (hexavalent and trivalent) free and substantially phosphate free. The inventive process can also be substantially free of heavy metals such as chromium, lead, cadmium, barium, among others. By substantially chromate free, substantially phosphate free and substantially heavy metal free it is meant that less than 5 wt. % and normally about 0 wt. % chromates, phosphates and/or heavy metals are present in a process for producing an article or the resultant article.

DETAILED DESCRIPTION

The instant invention relates to a process for depositing or forming a beneficial surface (e.g., a mineral containing coating or film) upon a metallic surface. The process contacts at least a portion of a metal surface with a medium comprising at least one oxygen containing water soluble compound, e.g., containing soluble mineral components or precursors thereof, having controlled concentration, temperature and pH wherein the metal surface is at least partially corroded or solubilized. By "oxygen containing water soluble compound" it is meant to refer to at least one member selected from the group of borates, aluminates, zironcates, titanates, molybdates, tungstenates, stannates, nitrates, sulfates, vanadates, cerium hydrates, water soluble manganese and magnesium compounds, nickel compounds, cobalt compounds, among other oxygenated water soluble compounds capable of interacting with a metal surface. By "mineral containing coating", "mineralized film" or "mineral" it is meant to refer to a relatively thin coating or film which is formed upon a metal surface wherein at least a portion of the coating or film comprises at least one metal containing mineral, e.g., an amorphous phase or matrix surrounding or incorporating crystals comprising a zinc disilicate. Mineral and Mineral Containing are defined in the previously identified Copending and Commonly Assigned Patents and Patent Applications; incorporated by reference.

By "metal containing", "metal", or "metallic", it is meant to refer to sheets, shaped articles, fibers, rods, particles, continuous lengths such as coil and wire, metallized surfaces, among other configurations that are based upon at least one of metals and alloys including a metal having a naturally occurring, or chemically, mechanically or thermally modified surface. Typically a naturally occurring surface upon a metal will comprise a thin film or layer comprising at least one oxide, hydroxides, carbonates, sulfates, chlorides, among others. The naturally occurring surface can be removed or modified by using the inventive process.

The metal containing surface refers to a metal article or body as well as a non-metallic member having an adhered metal or conductive layer. While any suitable surface can be treated by the inventive process, examples of suitable metal surfaces comprise at least one member selected from the group consisting of galvanized surfaces, sheradized surfaces, zinc, iron, steel, brass, copper, nickel, tin, aluminum, lead, cadmium, magnesium, alloys thereof such as zinc-nickel alloys, tin-zinc alloys, zinc-cobalt alloys, zinc-iron alloys, among others. If desired, the mineral layer can be formed on a non-conductive substrate having at least one surface coated with a metal, e.g., a metallized polymeric article or sheet, ceramic materials coated or encapsulated within a metal, among others. Examples of metallized polymer comprise at least one member selected from the group of polycarbonate, acrylonitrile butadiene styrene (ABS), rubber, silicone, phenolic, nylon, PVC, polyimide, melamine, polyethylene, polyproplyene, acrylic, fluorocarbon, polysulfone, polyphenyene, polyacetate, polystyrene, epoxy, among others. Conductive surfaces can also include carbon or graphite as well as conductive polymers (polyaniline for example).

The metal surface can possess a wide range of sizes and configurations, e.g., fibers, coils, sheets including perforated acoustic panels, chopped wires, drawn wires or wire strand/rope, rods, couplers (e.g., hydraulic hose couplings), fibers, particles, fasteners (including industrial and residential hardware), brackets, nuts, bolts, rivets, washers, cooling fins, stamped articles, powdered metal articles, among others. The limiting characteristic of the inventive process to treat a metal surface is dependent upon the ability of the surface to be contacted with the inventive medium.

The inventive process can be operated on a batch or continuous basis. The type of process will depend upon the configuration of the metal being treated. The contact time within the medium ranges from about 10 seconds to about 50 minutes and normally about 1 to about 15 minutes. The inventive process can be practiced in any suitable apparatus. Examples of suitable apparatus comprise a conventional barrel dip apparatus.

The medium can be a fluid bath, gel, spray, among other methods for contacting the substrate with the medium. Examples of the medium comprise a bath containing at least one oxygen containing water soluble compound, and a thickener, among others. The bath can comprise any suitable polar carrier such as water, alcohol, ethers, among others. Normally, the bath comprises at least one water-soluble compound and de-ionized water and optionally at least one dopant (e.g. a chloride). Typically, the at least one dopant is water soluble or dispersible within an aqueous medium.

The medium typically has a basic pH. Normally, the pH will range from greater than about 9 to about 13 and typically, about 10 to about 11. The pH of the medium can be monitored and maintained by using conventional detection methods. Alternatively, the medium can have an acidic pH. The selected pH will depend upon whether the metal surface is at least partially dissolved (or solubilized). That is, the inventive process employs a medium that is at least somewhat corrosive to the metal surface in order to enhance an interaction between the medium and the metal.

The medium is normally aqueous and can comprise at least one water soluble or dispersible compound in an amount from greater than about 0 to about 40 wt. %, usually, about 3 to 15 wt. % and typically about 10 wt. %. The medium is also normally substantially free of heavy metals, chromates and/or phosphates.

The temperature of the medium can be controlled to optimize the interaction between the medium and a metal surface. Normally, the temperature will range from about 50 C to at least about 100 C and typically about 80 to 100 C. This temperature can be maintained by using conventional heaters and related control systems.

The chemical and/or physical properties of the medium can be affected by exposing the medium to a source of electrical or magnetic energy. For example, the bath can be exposed to a source of energy such as the electrical current described in copending and commonly assigned U.S. Ser. No. 09/824,641; hereby incorporated by reference. Such exposure can improve the interaction between the medium and the metal surface, partially polymerize the medium, modify the metal to oxygen ratio, concentrate the medium, among other desirable properties.

The medium can be modified by adding water/polar carrier dispersible or soluble polymers. If utilized, the amount of polymer or water dispersible materials normally ranges from about 0 wt. % to about 10 wt. %. Examples of polymers or water dispersible materials that can be employed in the medium comprise at least one member selected from the group of acrylic copolymers (supplied commercially as Carbopol®), hydroxyethyl cellulose, clays such as bentonite, fumed silica, among others.

In an aspect of the invention, the medium is modified to include at least one dopant material. The dopants can be useful for building additional thickness of the deposited layer. The amount of dopant can vary depending upon the properties of the dopant and desired results. Typically, the amount of dopant will range from about 0.001 wt. % to about 5 wt. % (or greater so long as the deposition rate is not adversely affected). Examples of suitable dopants comprise at least one member selected from the group of water soluble salts, oxides and precursors of tungsten, molybdenum, titanium (titatantes), zircon, vanadium, phosphorus, aluminum (aluminates), iron (e.g., iron chloride), boron (borates), bismuth, gallium, tellurium, germanium, antimony, niobium (also known as columbium), magnesium and manganese, sulfur, zirconium (zirconates) mixtures thereof, among others, and usually, salts and oxides of aluminum and iron, and other water soluble or dispersible monovalent species. The dopant can comprise at least one of molybdenic acid, fluorotitanic acid and salts thereof such as titanium hydrofluoride, ammonium fluorotitanate, ammonium fluorosilicate and sodium fluorotitanate; fluorozirconic acid and salts thereof such as $H_2ZrF_6$, $(NH_4)_2ZrF_6$ and $Na_2ZrF_6$; among others. Alternatively, dopants can comprise at least one substantially water insoluble material such as electropheritic transportable polymers, PTFE, boron nitride, silica, silicon carbide, silicon nitride, aluminum nitride, titanium carbide, diamond, titanium diboride, tungsten carbide, metal oxides such as cerium oxide, powdered metals and metallic precursors such as zinc, among others.

The aforementioned dopants can be employed for enhancing mineral layer formation rate, modifying the chemistry and/or physical properties of the resultant layer, as a diluent for the medium, among others. Examples of such dopants are iron salts (ferrous chloride, sulfate, nitrate), aluminum fluoride, fluorosilicates (e.g., K2SiF6), fluoroaluminates (e.g., potassium fluoroaluminate such as K2AlF5-H2O), mixtures thereof, among other sources of metals and halogens. The dopant materials can be introduced to the metal surface in pretreatment steps, in post treatment steps (e.g., rinse), and/or by alternating exposing the metal surface to solutions of dopants and solutions of the medium. The presence of dopants in the medium can be employed to form tailored surfaces upon the metal, e.g., an aqueous solution containing aluminate can be employed to form a layer comprising oxides of boron and aluminum. That is, at least one dopant (e.g., zinc) can be co-deposited along with at least one water soluble species (e.g., a mineral) upon the substrate.

The medium can also be modified by adding at least one diluent. Examples of suitable diluent comprise at least one member selected from the group of sodium sulphate, surfactants, de-foamers, colorants/dyes, conductivity modifiers, among others. The diluent (e.g., sodium sulfate) can be employed for reducing the affects of contaminants entering the medium, reducing bath foam, among others. When the diluent is employed as a defoamer, the amount normally comprises less than about 5 wt. % of the medium, e.g., about 1 to about 2 wt. %.

In some cases the effectiveness of the deposition can be improved by introducing an electrical current into the medium. The metal surface can be employed as either the anode or cathode (e.g., as described in aforementioned U.S. patent application Ser. No. 09/814,641). Typically, when the medium is acidic the metal surface comprises the anode whereas for basic mediums the metal surface comprises the cathode. The current and voltage can be varied but normally the conditions are such that hydrogen evolves from the cathode and oxygen from the anode.

Contact with the inventive medium can be preceded by and/or followed with conventional pre-treatments and/or post-treatments known in this art such as cleaning or rinsing, e.g., immersion/spray within the treatment, sonic cleaning, double counter-current cascading flow; alkali or acid treatments, among other treatments. By employing a suitable post- or pre-treatment the solubility, corrosion resistance (e.g., reduced white rust formation when treating zinc containing surfaces), sealer and/or topcoat adhesion, among other properties of surface of the substrate formed by the inventive method can be improved. If desired, the post-treated surface can be sealed, rinsed and/or topcoated, e.g., silane, epoxy, latex, fluoropolymer, acrylic, among other coatings.

In one aspect of the invention, a pre-treatment comprises exposing the substrate to be treated to at least one of an acid, oxidizer, a basic solution (e.g., zinc and sodium hydroxide) among other compounds. The pre-treatment can be employed for removing excess oxides or scale, equipotentialize the surface for subsequent mineralization treatments, convert the surface into a mineral precursor, among other benefits. Conventional methods for acid cleaning metal surfaces are described in ASM, Vol. 5, Surface Engineering (1994), and U.S. Pat. No. 6,096,650; hereby incorporated by reference.

In one aspect of the invention, the metal surface is pre-treated or cleaned electrolytically by being exposed to an anodic environment. That is, the metal surface is exposed to the medium wherein the metal surface is the anode and a current is introduced into the medium. By using the metal as the anode in a DC cell and maintaining a current of about 10A/ft2 to about 150A/ft 2, the process can generate oxygen gas. The oxygen gas agitates the surface of the workpiece while oxidizing the substrate's surface. The surface can also be agitated mechanically by using conventional vibrating equipment. If desired, the amount of oxygen or other gas present during formation of the mineral layer can be increased by physically introducing such gas, e.g., bubbling, pumping, among other means for adding gases.

If desired, the inventive method can include a thermal post-treatment. The metal surface can be removed from the silicate medium, dried (e.g., at about 120 to about 150 C for about 2.5 to about 10 minutes), rinsed in deionized water and then dried. The dried surface may be processed further as desired; e.g. contacted with a sealer, rinse or topcoat. In an aspect of the invention, the thermal post treatment comprises heating the surface. Typically the amount of heating is sufficient to consolidate or densify the inventive surface without adversely affecting the physical properties of the underlying metal substrate. Heating can occur under atmospheric conditions, within a nitrogen containing environment, among other gases. Alternatively, heating can occur in a vacuum. The surface may be heated to any temperature within the stability limits of the surface coating and the surface material. Typically, surfaces are heated from about 75° C. to about 250° C., more typically from about 120° C. to about 200° C. If desired, the heat treated component can be rinsed in water to remove any residual water soluble species and then dried again (e.g., dried at a temperature and time sufficient to remove water).

In one aspect of the invention, a post treatment comprises exposing the substrate to a source of at least one carbonate or precursors thereof. Examples of carbonate comprise at least one member from the group of gaseous carbon dioxide, lithium carbonate, lithium bicarbonate, sodium carbonate, sodium bicarbonate, potassium carbonate, potassium bicarbonate, rubidium carbonate, rubidium bicarbonate, rubidium acid carbonate, cesium carbonate, ammonium carbonate, ammonium bicarbonate, ammonium carbamate and ammonium zirconyl carbonate. Normally, the carbonate source will be water soluble. In the case of a carbonate precursor such as carbon dioxide, the precursor can be passed through a liquid (including the medium) and the substrate immersed in the liquid. One specific example of a suitable postreatment is disclosed in U.S. Pat. No. 2,462,763; hereby incorporated by reference. Another specific example of a post treatment comprises exposing a treated surface to a solution obtained by diluting ammonium zirconyl carbonate (1:4) in distilled water (e.g., Bacote® 20 supplied by Magnesium Elektron Corp). If desired, the surface treated by the inventive process is dried and, then, post-treated with a carbonate (e.g., zirconyl ammonium carbonate). Further in some case, a carbonate post treated surface can be topcoated (e.g., aqueous or water borne topcoats).

In another aspect of the invention, the post treatment comprises heating the surface. Typically the amount of heating is sufficient to densify the inventive surface without adversely affecting the physical properties of the underlying metal substrate. Heating can occur under atmospheric conditions, within a nitrogen containing environment, among other gases. If desired, prior to heating the inventive surface can be contacted with a solution containing a material that interacts with the surface at elevated temperatures, e.g., a eutectic formed between the metal surface and at least one of silica, alumina, B203, iron oxide, MgO, among other compounds. Normally, the heating will be sufficient to cause sintering or a desirable interaction without adversely affecting the underlying metal.

In another aspect of the invention, the post treatment comprises exposing the substrate to a source comprising at least one acid source or precursors thereof. Examples of suitable acid sources comprise at least one member chosen from the group of phosphoric acid, hydrochloric acid, molybdic acid, silicic acid, acetic acid, citric acid, nitric acid, hydroxyl substituted carboxylic acid, glycolic acid, lactic acid, malic acid, tartaric acid, ammonium hydrogen citrate, ammonium bifluoride, fluoboric acid, fluorosilicic acid, among other acid sources effective at improving at least one property of the treated metal surface. The Ph of the acid post treatment may be modified by employing at least one member selected from the group consisting of ammonium citrate dibasic (available commercially as Citrosol® #503 and Multiprep®), fluoride salts such as ammonium bifluoride, fluoboric acid, fluorosilicic acid, among others. The acid post treatment can serve to activate the surface thereby improving the effectiveness of rinses, sealers and/or topcoatings (e.g., surface activation prior to contacting with a sealer can improve cohesion between the surface and the sealer thereby improving the corrosion resistance of the treated substrate). Normally, the acid source will be water soluble and employed in amounts of up to about 15 wt. % and typically, about 1 to about 5 wt. % and have a Ph of less than about 5.5.

In another aspect of the invention, the post treatment comprises contacting a surface treated by the inventive process with a rinse. By "rinse" it is meant that an article or a treated surface is sprayed, dipped, immersed or other wise exposed to the rinse in order to affect the properties of the treated surface. For example, a surface treated by the inventive process is immersed in a bath comprising at least one rinse. In some cases, the rinse can interact or react with at least a portion of the treated surface. Further the rinsed surfaced can be modified by multiple rinses, heating, topcoating, adding dyes, lubricants and waxes, among other processes. Examples of suitable compounds for use in rinses comprise at least one member selected from the group of titanates, titanium chloride, tin chloride, zirconates, zirconium acetate, zirconium oxychloride, fluorides such as calcium fluoride, tin fluoride, titanium fluoride, zirconium fluoride; coppurous compounds, ammonium fluorosilicate, metal treated silicas (e.g., Ludox®), nitrates such as aluminum nitrate; sulphates such as magnesium sulphate, sodium sulphate, zinc sulphate, and copper sulphate; lithium compounds such as lithium acetate, lithium bicarbonate, lithium citrate, lithium metaborate, lithium vanadate, lithium tungstate, among others. The rinse can further comprise at least one organic compound such as vinyl acrylics, fluorosurfactancts, polyethylene wax, among others. Examples of commercially available sealers, rinses and topcoats comprise at least one member selected from the group of Aqualac® (urethane containing aqueous solution), W86®, W87®, B37®, T01®, E10®, B17, B18 among others (a heat cured coating supplied by the Magni® Group), JS2030S (sodium silicate containing rinse supplied by MacDermid Incorporated), JS20401 (a molybdenum containing rinse also supplied by MacDermid Incorporated), EnSeal® C-23 (an acrylic based coating supplied by Enthone), EnSeal® C-26, Enthone® C-40 (a pigmented coating supplied Enthone), Microseal®, Paraclene® 99 (a chromate containing rinse), EcoTri® (a silicate/polymer rinse), MCI Plus OS (supplied by Metal Coatings International), silanes (e.g., Dow Corning Z-6040, Gelest SIA 0610.0, among others), ammonium zirconyl carbonate (e.g., Bacote 20), urethanes (e.g., Agate L18), among others. One specific rinse comprises water, water dispersible urethane, and at least one silicate, e.g., refer to commonly assigned U.S. Pat. No. 5,871,668; hereby incorporated by reference. While the rinse can be employed neat, normally the rinse will be dissolved, diluted or dispersed within another medium such as water, organic solvents, among others. While the amount of rinse employed depends upon the desired results, normally the rinse comprises about 0.1 wt % to about 50 wt. % of the rinse medium. The rinse can be employed as multiple applications and, if desired, heated. Moreover, the aforementioned rinses can be modified by incorporating at least one dopant, e.g. the aforementioned dopants. The dopant can employed for interacting or reacting with the treated surface. If desired, the dopant can be dispersed in a suitable medium such as water and employed as a rinse.

The inventive process can create a flexible surface that can survive secondary processes, e.g., metal deformation for riveting, sweging, crimping, among other processes, and continue to provide corrosion protection. Such is in contrast to typical corrosion inhibitors such as chromates that tend to crack when the underlying surface is shaped. If desired, the surface formed by the inventive process can be topcoated (e.g, with a heat cured epoxy), prior to secondary processing. Articles treated in accordance with the inventive process, topcoated and exposed to a secondary process retain their desirable corrosion resistance, coating adhesion, component functionality, among properties.

The inventive process can provide a surface (e.g., mineral coating) that can enhance the surface characteristics of the metal or conductive surface such as resistance to corrosion, protect carbon (fibers for example) from oxidation, stress crack corrosion (e.g., stainless steel), hardness, thermal resistance, improve bonding strength in composite materials, provide dielectric layers, improve corrosion resistance of printed circuit/wiring boards and decorative metal finishes, and reduce the conductivity of conductive polymer surfaces including application in sandwich type materials.

The mineral coating can also affect the electrical and magnetic properties of the surface. That is, the mineral coating can impart electrical resistance or insulative properties to the treated surface. By having an electrically non-conductive surface, articles having the inventive layer can reduce, if not eliminate, electro-galvanic corrosion in fixtures wherein current flow is associated with corrosion, e.g., bridges, pipelines, among other articles.

Depending upon the intended usage of the workpiece treated by the inventive method, the workpiece can be coated with a secondary coating or layer. Alternatively, the treated workpiece can be rinsed (as described above) and then coated with a secondary coating or layer. Examples of such secondary coatings or layers comprise one or more members of acrylic coatings (e.g., IRILAC®), e-coats, silanes including those having amine, acrylic and aliphatic epoxy functional groups, latex, urethane, epoxies, silicones, alkyds, phenoxy resins (powdered and liquid forms), radiation curable coatings (e.g., UV curable coatings), lacquer, shellac, linseed oil, among others. Secondary coatings can be solvent or water borne systems. The secondary coatings can be applied by using any suitable conventional method such as immersing, dip-spin, spraying, among other methods. The secondary coatings can be cured by any suitable method such as UV exposure, heating, allowed to dry under ambient conditions, among other methods. An example of UV curable coating is described in U.S. Pat. Nos. 6,174,932 and 6,057,382; hereby incorporated by reference. Normally, the surface formed by the inventive process will be rinsed, e.g., with at least one of deionized water, silane or a carbonate, prior to applying a topcoat. The secondary coatings can be employed for imparting a wide range of properties such as improved corrosion resistance to the underlying mineral layer, reduce torque tension, a temporary coating for shipping the treated workpiece, decorative finish, static dissipation, electronic shielding, hydrogen and/or atomic oxygen barrier, among other utilities. The mineral coated metal, with or without the secondary coating, can be used as a finished product or a component to fabricate another article.

The thickness of the rinse, sealer and/or topcoat can range from about 0.00001 inch to about 0.025 inch. The selected thickness varies depending upon the end use of the coated article. In the case of articles having close dimensional tolerances, e.g., threaded fasteners, normally the thickness is less than about 0.00005 inch.

In another aspect, the treated metal surface is contacted with a secondary coating. Examples of such secondary coatings and methods that can be complimentary to the instant invention are described in U.S. Pat. Nos. 5,759,629; 5,750,197; 5,539,031; 5,498,481; 5,478,655; 5,455,080; and 5,433,976. The disclosure of each of these U.S. patents is hereby incorporated by reference. For example, improved corrosion resistance of a metal substrate can be achieved by using a secondary coating comprising at least one suitable silane (e.g., in the medium, rinse, sealer and/or topcoat) in combination with a mineralized surface. Examples of suitable silanes comprise at least one members selected from the group consisting of tetra-ortho-ethyl-silicate (TEOS), bis-1, 2-(triethoxysilyl) ethane (BSTE), vinyl silane or aminopropyl silane, epoxy silanes, vinyltriactosilane, alkoxysilanes, among other organo functional silanes. The silane can bond with the mineralized surface and then the silane can cure thereby providing a protective top coat, or a surface for receiving an outer coating or layer. In some cases, it is desirable to sequentially apply the silanes. For example, a steel substrate, e.g., a fastener, can be treated by the inventive process to form a mineral layer, allowed to dry, rinsed in deionized water, coated with a 5% BSTE solution, coated again with a 5% vinyl silane solution, and powder coated with a thermoset epoxy paint (Corvel 10-1002 by Morton) at a thickness of 2 mils.

The inventive process forms a surface that may have improved adhesion to outer coatings or layers, e.g., secondary coatings. Examples of suitable outer coatings comprise at least one member selected from the group consisting of acrylics, epoxies, e-coats, latex, urethanes, silanes (e.g., TEOS, MEOS, among others), fluoropolymers, alkyds, silicones, polyesters, oils, gels, grease, among others. An example of a suitable epoxy comprises a coating supplied by The Magni® Group as B17 or B18 top coats, e.g, a galvanized article that has been treated in accordance with the inventive method and contacted with at least one silane and/or ammonium zirconium carbonate and top coated with a heat cured epoxy (Magni® B18) thereby providing a chromate free corrosion resistant article. By selecting appropriate rinses, secondary and outer coatings for application upon the mineral, a corrosion resistant article can be obtained without chromating or phosphating. Such a selection can also reduce usage of zinc to galvanize iron containing surfaces, e.g., a steel surface is mineralized, coated with a silane containing coating and with an outer coating comprising an epoxy.

Without wishing to be bound by any theory or explanation, it is believed that the inventive process forms a surface that can release or provide water or related moieties. These moieties can participate in a hydrolysis or condensation reaction that can occur when an overlying rinse, seal or topcoating cures. Such participation improves the cohesive bond strength between the surface and overlying cured coating.

The surface formed by the inventive process can also be employed as an intermediate or tie-layer for glass coatings, glass to metal seals, hermetic sealing, among other applications wherein it is desirable to have a joint or bond between a metallic substrate and a glass layer or article. The inventive surface can serve to receive molten fluids (e.g., zinc, aluminum, steel, borosilicate, aluminosilicate, phosphate, among other glasses), while protecting the underlying metallic substrate and forming a seal.

The inventive process can provide a surface that improves adhesion between a treated substrate and an adhesive. Examples of adhesives comprise at least one member selected from the group consisting of hot melts such as at least one member selected from the group of polyamides, polyimides, butyls, acrylic modified compounds, maleic anhydride modified ethyl vinyl acetates, maleic anhydride modified polyethylenes, hydroxyl terminated ethyl vinyl acetates, carboxyl terminated ethyl vinyl acetates, acid terpolymer ethyl vinyl acetates, ethylene acrylates, single phase systems such as dicyanimide cure epoxies, polyamide cure systems, lewis acid cure systems, polysulfides, moisture cure urethanes, two phase systems such as epoxies, activated acrylates polysulfides, polyurethanes, among others. Two metal substrates having surfaces treated in accordance with the inventive process can be joined together by using an adhesive. Alternatively one substrate having the inventive surface can be adhered to another material, e.g., joining treated metals to plastics, ceramics, glass, among other surfaces. In one specific aspect, the substrate comprises an automotive hem joint wherein the adhesive is located within the hem.

The improved cohesive and adhesive characteristics between a surface formed by the inventive process and polymeric materials can permit forming acoustical and mechanical dampeners, e.g., constraint layer dampers such as described in U.S. Pat. No. 5,678,826 hereby incorporated by reference, motor mounts, bridge/building bearings, HVAC silencers, highway/airport sound barriers, among other articles. The ability to improve the bond between vistoelastomeric materials sandwiched between metal panels in dampers reduces sound transmission, improves formability of such panels, reduces process variability, among other improvements. The metal panels can comprise any suitable metal such as 304 steel, stainless steel, aluminum, cold rolled steel, zinc alloys, hot dipped zinc or electrogalvanized, among other materials. Examples of polymers that can be bonded to the inventive surface and in turn to an underlying metal substrate comprise any suitable material such as neoprene, EPDM, SBR, EPDM, among others. The inventive surface can also provide elastomer to metal bonds described in U.S. Pat. No. 5,942,333; hereby incorporated by reference.

The inventive process can employ dopants, rinses, sealers and/or topcoats for providing a surface having improved thermal and wear resistance. Such surfaces can be employed in gears (e.g., transmission), powdered metal articles, exhaust systems including manifolds, metal flooring/grates, heating elements, among other applications wherein it is desirable to improve the resistance of metallic surfaces.

In another aspect of the invention, the inventive process can be used to produce a surface that reduces, if not eliminates, molten metal adhesion (e.g., by reducing intermetallic formation). Without wishing to be bound by any theory or explanation, it is believed that the inventive process provides an ablative and/or a reactive film or coating upon an article or a member that can interact or react with molten metal thereby reducing adhesion to the bulk article. For example, the inventive process can provide an inorganic iron or a zinc containing film or layer upon a substrate in order to shield or isolate the substrate from molten metal contact (e.g., molten aluminum or magnesium). The effectiveness of the film or layer can be improved by applying an additional coating comprising silica (e.g., to function as an ablative when exposed to molten metal). The ability to prevent molten metal adhesion is desirable when die casting aluminum or magnesium over zinc cores, die casting aluminum for electronic components, among other uses. The molten metal adhesion can be reduced further by applying one of the aforementioned topcoatings, e.g. Magni® B18, acrylics, polyesters, among others. The topcoatings can be modified (e.g., to be more heat resistant) by adding a heat resistant material such as colloidal silica (e.g., Ludox® which can also be added to the medium and rinse).

While the above description places particular emphasis upon forming a mineral containing layer upon a metal surface, the inventive process can be combined with or replace conventional metal pre or post treatment and/or finishing practices. Conventional post coating baking methods can be employed for modifying the physical characteristics of the mineral layer, remove water and/or hydrogen, among other modifications. The inventive mineral layer can be employed to protect a metal finish from corrosion thereby replacing conventional phosphating process, e.g., in the case of automotive metal finishing the inventive process could be utilized instead of phosphates and chromates and prior to coating application e.g., E-Coat. The inventive process can be employed for imparting enhanced corrosion resistance to electronic components. The inventive process can also be employed in a virtually unlimited array of end-uses such as in conventional plating operations as well as being adaptable to field service. For example, the inventive mineral containing coating can be employed to fabricate corrosion resistant metal products that conventionally utilize zinc as a protective coating, e.g., automotive bodies and components, grain silos, bridges, among many other end-uses. Moreover, depending upon the dopants and concentration thereof present in the mineral deposition solution, the inventive process can produce microelectronic films, e.g., on metal or conductive surfaces in order to impart enhanced electrical/magnetic (e.g., EMI shielding, reduced electrical connector fretting, reduce corrosion caused by dissimilar metal contact, among others), and corrosion resistance, or to resist ultraviolet light and monotomic oxygen containing environments such as outer space.

The following Examples are provided to illustrate certain aspects of the invention and it is understood that such an Example does not limit the scope of the invention.

EXAMPLES

The examples illustrate electroless deposition that was conducted in NaOH solution along with various oxygen containing water soluble compounds. All deposition studies were done at a Ph of 11 and temperature of 75° C. The mineralization process was done on bare steel, Sn plated steel, hot dip galvanized steel and electro-galvanized steel using the following solutions:

- Deposition in NaOH solution+1 g/L sodium stannate trihydrate
- Deposition in NaOH+1 g/L sodium molybdate dihydrate
- Deposition in NaOH solution+1 g/L ammonium metavanadate
- Deposition in NaOH solution+1 g/L cerium nitrate hexahydrate Subsequent to electroless deposition, the panels were removed from the bath and washed with deionized (DI) water immediately.

Next, the corrosion characteristics of the panel were studied in 0.5 M $Na_2SO_4$ solution at Ph 4. A representative panel area of 1 $cm^2$ was chosen for testing. A three-electrode setup was used to study the corrosion behavior of the mineralized samples. The electrolyte used in this study is 0.5 M sodium sulfate, Ph=4. Ti coated with Pd was used as the counter electrode. $Hg/Hg_2SO_4$ was used as the reference electrode. All potentials in this study are referred with respect to the $Hg/Hg_2SO_4$ electrode. Corrosion studies were done using Scribner Associates Corrware Software with EG&G Princeton applied Model 273 potentiostat/galvanostat and a Solartron 1255 frequency analyzer. The electrode was left on open circuit till it's potential stabilized. After the potential stabilized, non-destructive evaluation of the surface was done using linear polarization and impedance analysis. During linear polarization, the potential was varied 10 Mv above and below the open circuit potential of the mineralized sample at a scan rate of 0.1667 Mv/s. The impedance data generally covered a frequency range of 5 mHz to 10 kHz. A sinusoidal ac voltage signal varying by ±10 Mv was applied. The electrode was stable during the experiments and its open circuit potential changed less than 1 Mv.

The results of the corrosion studies are detailed below in Tables 1–3.

TABLE 1

| Substrate | Specimen # | Corrosion Resistance for Samples Immersed in NaOH + Sodium Stannate Solution: Rp (Ω – cm²) | | | | Rp – Avg (Ω – cm²) |
|---|---|---|---|---|---|---|
| Fe—Sn | 1 | 365106 | 316867 | 356816 | 542530 | 395329.8 |
| Steel (Fe) | 2 | 4194 | 5136 | 3718 | 5061 | 4527.25 |
| Steel (Fe) | 3 | 4807 | 8061 | 13443 | 754 | 6766.25 |
| Galvalume | 4 | 1111 | 1516 | 1374 | 854 | 1213.75 |
| Galvalume | 5 | 1596 | 1886 | 1395 | 678 | 1388.75 |
| Fe—Zn | 6 | 1009 | 330 | 852 | 935 | 781.5 |
| Fe—Zn | 7 | 1601 | 750 | 902 | 355 | 902 |

TABLE 2

| Substrate | Specimen # | Corrosion Resistance for Samples Immersed in NaOH + Sodium Molybdate Solution: Rp (Ω – cm²) | | | | Rp – Avg (Ω – cm²) |
|---|---|---|---|---|---|---|
| Fe—Sn | 1 | 139047 | 252466 | 378666 | 234211 | 251098 |
| | 2 | 20096 | 656490 | 331291 | 3121 | 252750 |
| Steel (Fe) | 3 | 841 | 1186 | 994 | 817 | 959.5 |
| Steel (Fe) | 4 | 1478 | 794 | 1120 | 885 | 1069.25 |
| Galvalume | 5 | 2567 | 1957 | 1496 | 1846 | 1966.5 |
| Galvalume | 6 | 2120 | 2013 | 2173 | 1553 | 1964.75 |
| Fe—Zn | 7 | 870 | 816 | 779 | 798 | 815.75 |
| Fe—Zn | 8 | 959 | 1181 | 834 | 1150 | 1031 |

TABLE 3

| Substrate | Specimen # | Corrosion Resistance for Samples Immersed in NaOH + Cerium Nitrate: Rp (Ω – cm²) | | | | Rp – Avg (Ω – cm²) |
|---|---|---|---|---|---|---|
| Fe—Sn | 1 | 50861 | 170332 | 46192 | 20867 | 72063 |
| | 2 | 36760 | 76518 | 140604 | 53238 | 76780 |
| Steel (Fe) | 3 | 747 | 495 | 848 | 947 | 759.25 |
| Steel (Fe) | 4 | 544 | 1323 | 629 | 1269 | 941.25 |
| Galvalume | 5 | 838 | 364 | 1329 | 947 | 869.5 |
| Galvalume | 6 | 1363 | 1214 | 1354 | 879 | 1202.5 |
| Fe—Zn | 7 | 1065 | 1074 | 1344 | 947 | 1107.5 |
| Fe—Zn | 8 | 723 | 682 | 846 | 663 | 728.5 |

What is claimed is:

1. A method for treating a substrate having an electrically conductive surface comprising:

contacting at least a portion of the surface with an aqueous medium comprising at least one member selected from the group consisting of water soluble stannates, molybdates, vanadates and cerium compounds and having a basic pH, heating the substrate, rinsing the substrate, and;

drying the substrate; wherein the method is substantially free of chromates.

2. The method of claim 1 wherein the aqueous medium comprises a combination comprising water, at least one member selected from the group consisting of water soluble stannates, vanadates and hydrated cerium compounds, wherein the medium has a basic pH and is substantially free or chromates.

3. The method of claim 2 wherein said medium further comprises colloidal silica.

4. The method of claim 1 wherein the surface comprises at least one member selected from the group consisting of copper, nickel, tin, iron, zinc, aluminum, magnesium, stainless steel and steel and alloys thereof.

5. The method of claim 1 wherein said heating is to a temperature of at least about 120° C.

6. The method of claim 1 further comprising applying at least one coating upon the dried surface.

7. The method of claim 1 further comprising applying an adherent composition comprising at least one member chosen from the group of latex, silanes, epoxies, silicone, amines, alkyds, urethanes and acrylics, after said drying.

8. The method of claim 1 wherein said medium is heated ac a temperature of about 50 to about 100° C.

9. The method of claim 1 wherein said rinsing comprises contacting with a second medium comprising at least one dopant.

10. The method of claim 2 wherein said water soluble compounds comprise at least one member selected from the group consisting of sodium stannate hydrate, ammonium metavanadate and cerium nitrate hydrate.

11. The method of claim 1 further comprising treating the substrate prior to said contacting with at least one process selected from the group consisting of contacting with an acidic medium, a basic medium and an oxidizing medium, and anodizing the substrate.

12. The method of claim 4 wherein the substrate comprises steel.

13. The method of claim 4 wherein the substrate comprises zinc or zinc alloys.

14. The method of claim 1 wherein the water soluble compound comprises at least one member selected from the group consisting of stannates, vanadates and cerium compounds.

15. The method of claim 14 wherein the water soluble compound comprises a cerium compound.

16. The method of claim 14 wherein the water soluble compound comprises a stannate compound.

17. The method of claim 14 wherein the water soluble compound comprises a vanadate compound.

18. The method of claim 1 wherein the aqueous medium comprises water, sodium hydroxide, at least one member selected from the group consisting of water soluble stannates, molybdates, vanadates and cerium compounds; wherein the medium has a basic pH and is substantially free of chromates.

19. The method of claim 18 wherein the water soluble compound comprises at least one member selected from the group consisting of stannates, vanadates and cerium compounds.

20. The method of claim 18 further comprising at least one water dispersible polymer.

* * * * *